US010696477B1

(12) United States Patent
Shek

(10) Patent No.: US 10,696,477 B1
(45) Date of Patent: Jun. 30, 2020

(54) ACTUATING GARBAGE BIN LID

(71) Applicant: Michael Shek, San Mateo, CA (US)

(72) Inventor: Michael Shek, San Mateo, CA (US)

( * ) Notice: Subject to any disclaimer, the term of this patent is extended or adjusted under 35 U.S.C. 154(b) by 0 days.

(21) Appl. No.: 16/552,627

(22) Filed: Aug. 27, 2019

(51) Int. Cl.
*G08B 21/00* (2006.01)
*B65F 1/16* (2006.01)

(52) U.S. Cl.
CPC .... *B65F 1/1638* (2013.01); *B65F 2001/1653* (2013.01); *B65F 2210/139* (2013.01); *B65F 2210/168* (2013.01)

(58) Field of Classification Search
CPC ..... B65F 1/1638; B65F 2001/1653; B65F 2210/139; B65F 2210/168
See application file for complete search history.

(56) References Cited

U.S. PATENT DOCUMENTS 4,996,467 A * 2/1991 Day ..... B65F 1/1638 318/283
5,329,212 A * 7/1994 Feigleson ..... B65F 1/1638 220/260
6,150,939 A * 11/2000 Lin ..... B65F 1/1426 248/147
9,586,755 B1 * 3/2017 Yang ..... E05F 15/73
9,856,080 B2 * 1/2018 Yang ..... B65F 1/1638
9,873,559 B2 * 1/2018 Nordlund ..... B65F 1/1405
2004/0257020 A1 * 12/2004 Boliver ..... B65F 1/1607 318/480

* cited by examiner

*Primary Examiner* — Phung Nguyen
(74) *Attorney, Agent, or Firm* — Muncy, Geissler, Olds & Lowe, P.C.

(57) ABSTRACT

An inductive garbage bin lid for being disposed on a barrel includes a main body and an opening system. The opening system is arranged on the main body and includes a lid, a processing unit, a lighting unit, and a driving unit. The lid covers the opening at a normal state. The sensing unit and the lighting unit are electrically connected to the processing unit respectively. The driving unit electrically connects the processing unit and the lid therebetween. When an object is detected by the sensing unit, the sensing unit sends an actuating signal to the processing unit to further actuate the driving unit to drive the lid to open to leave the opening. The processing unit selectively actuates the lighting unit to light at different lighting modes.

10 Claims, 6 Drawing Sheets

ACTUATING GARBAGE BIN LID

BACKGROUND OF THE INVENTION

Field of the Invention

The present invention relates to a garbage bin, more especially to an actuating garbage bin lid.

Description of the Prior Art

A garbage bin is usually used to collect garbage, and a lid is often used to block the odor or to prevent flies or other insects from entering the garbage bin.

However, when the user is holding object to be difficult to open the lid or the user doesn't want to touch the lid, an automatic lid can solve the problem.

However, it is inconvenient that the inductive lid sometimes closes wrongly during using.

SUMMARY OF THE INVENTION

The main object of the present invention is to provide an inductive garbage bin lid whose lighting unit can light at different lighting modes to make the user notice whether he is inside the sensing area in order to prevent the lid from closing wrongly.

To achieve the above and other objects, the inductive garbage bin lid of the present invention is for being disposed on a barrel. A receiving space is defined between the inductive garbage bin lid and the barrel. The inductive garbage bin lid includes a main body and an opening system.

The main body is formed with an opening for communicating the receiving space. The opening system is arranged on the main body and includes a lid, a processing unit, a lighting unit, and a driving unit. The lid is disposed on the main body to cover the opening at a normal state. The sensing unit and the lighting unit are electrically connected to the processing unit respectively. The driving unit electrically connects the processing unit and the lid therebetween. When an object is detected by the sensing unit in a sensing area, the sensing unit sends an actuating signal to the processing unit, the processing unit actuates the driving unit to drive the lid to open to leave the opening after received the actuating signal. The processing unit also actuates the lighting unit to light at a first lighting mode. When the opening is not covered by the lid and no object is detected by the sensing unit in the sensing area, the processing unit actuates the lighting unit to light at a second lighting mode different from the first lighting mode.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
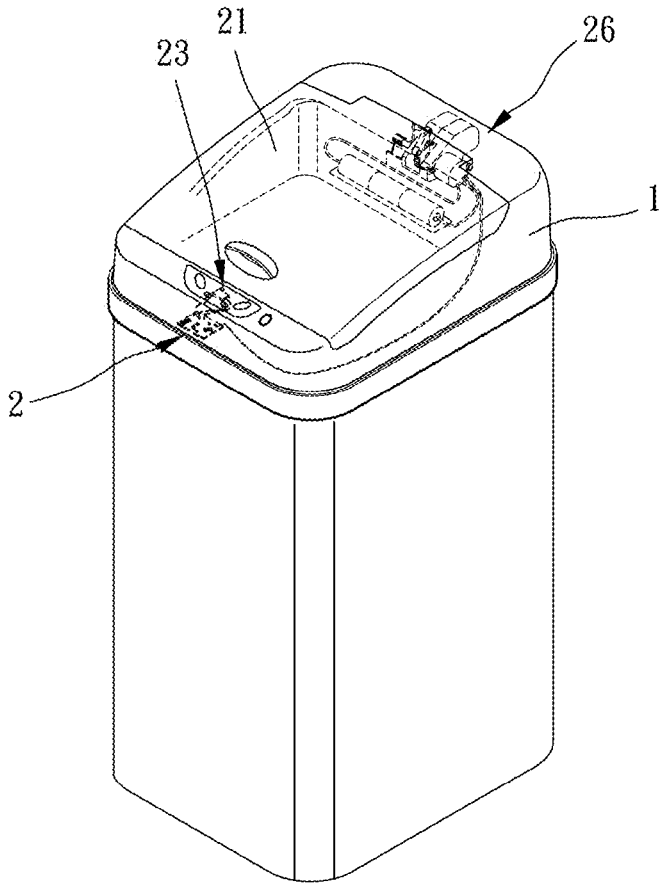
FIG. 1 is a stereogram of the present invention.
Figure 2:
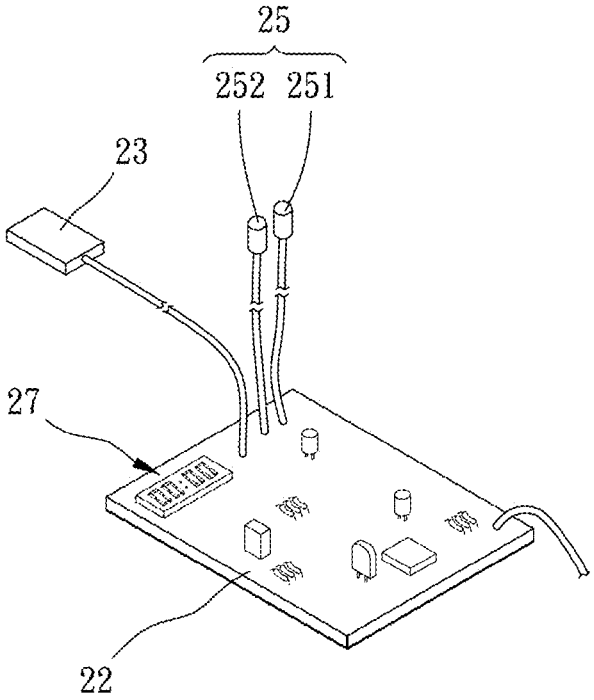
FIG. 2 is an illustration showing an electrical connection of the present invention.
Figure 3:
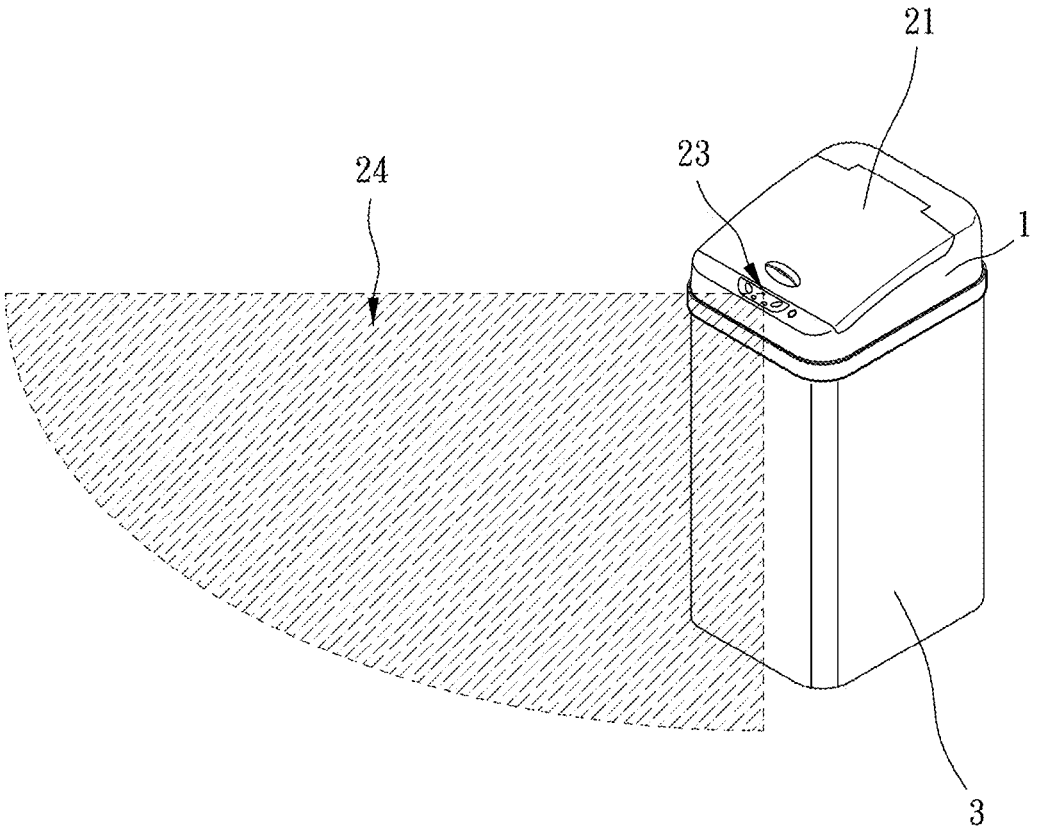
FIG. 3 is an illustration showing a sensing area of the present invention.
Figure 4:
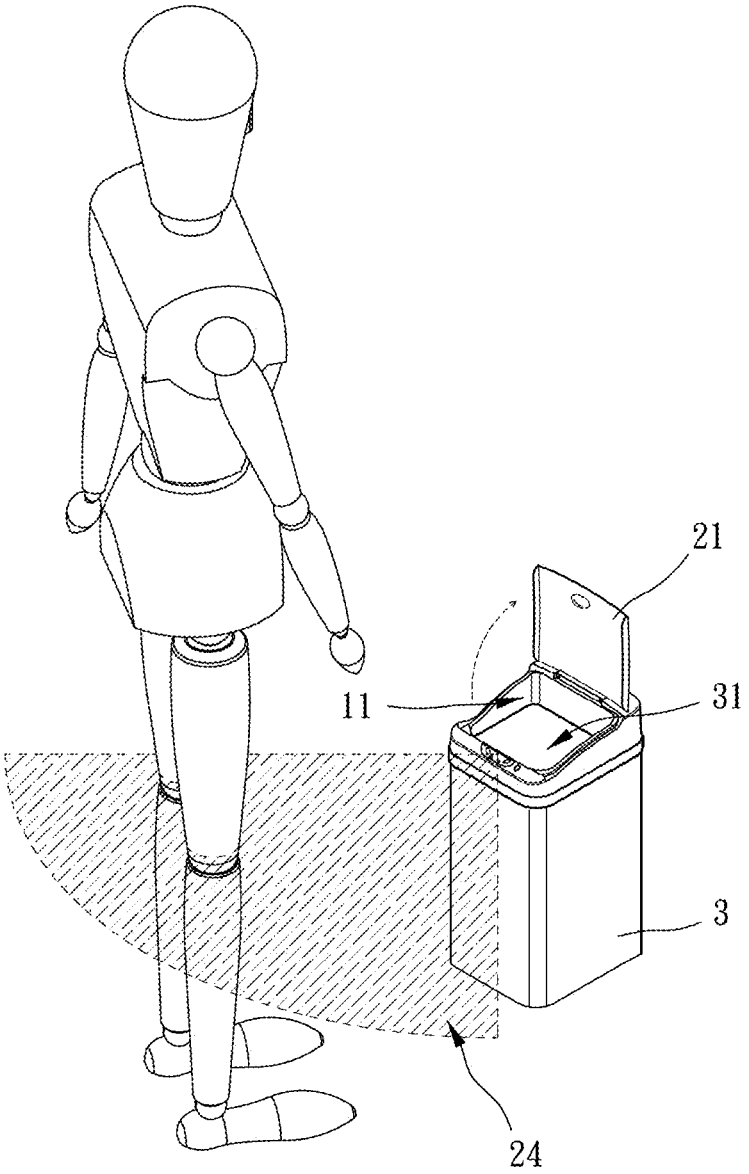
FIG. 4 is an illustration showing a lid opening of the present invention.
Figure 5:
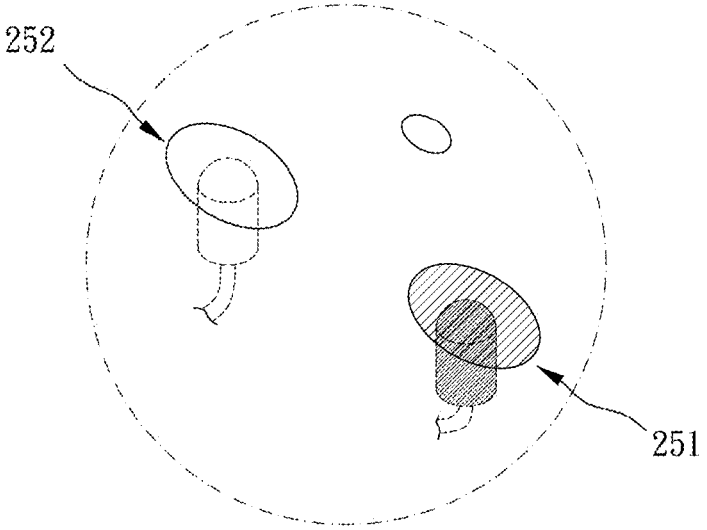
FIG. 5 is a partial enlargement of FIG. 4.
Figure 7:
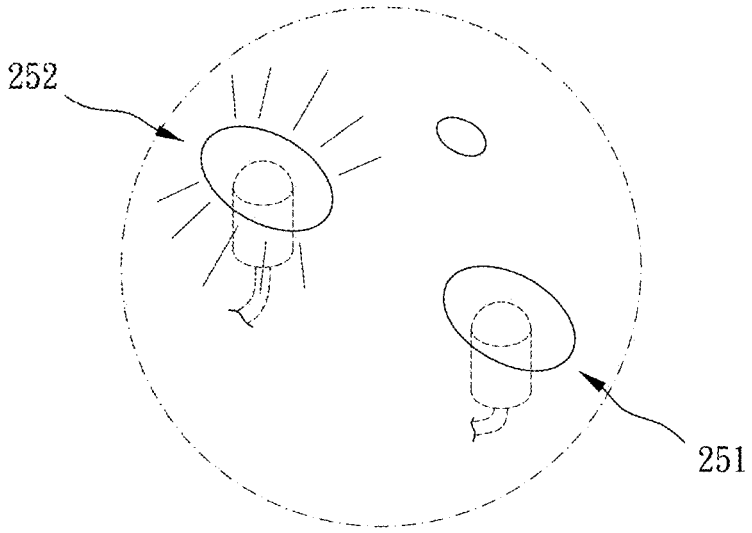
FIG. 7 is a partial enlargement of FIG. 6.
Figure 6:
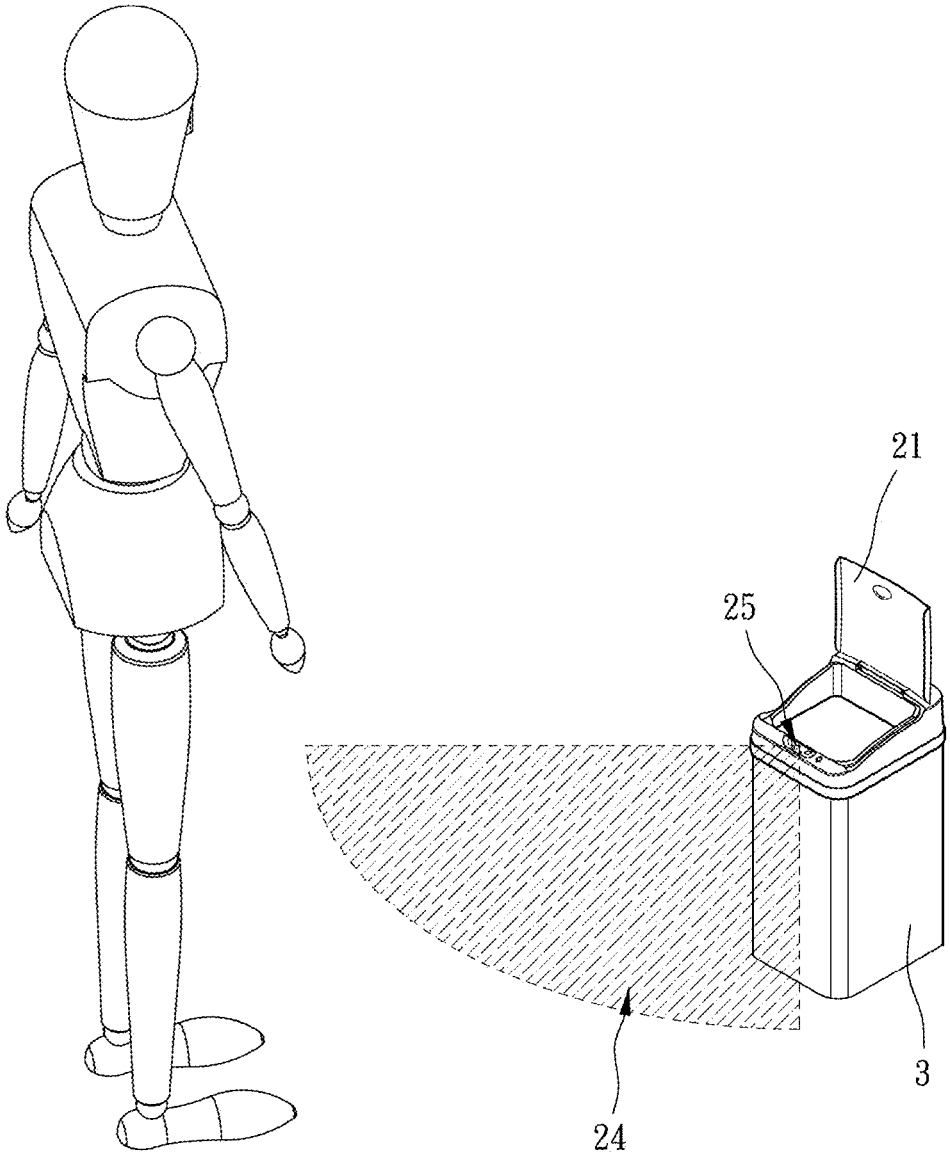
FIG. 6 is an illustration showing an object leaving a sensing area of the present invention.

Please refer to FIG. 1 to FIG. 7, the inductive garbage bin lid of the present invention is adapted for being disposed on a barrel 3 wherein a receiving space 31 is defined between the inductive garbage bin lid and the barrel 3. The inductive garbage bin lid includes a main body 1 and an opening system 2. The main body 1 is formed with an opening 11 communicating the receiving space 31. The opening system 2 is disposed on the main body 1 and includes a lid 21, a processing unit 22, a sensing unit 23, a lighting unit 25, and a driving unit 26. The lid 21 is disposed on the main body 1 and covers the opening 11 at a normal state. The sensing unit 23 and the lighting unit 25 are electrically connected to the processing unit 22 respectively. The driving unit 26 electrically connects the processing unit 22 and the lid 21 therebetween.

When the sensing unit 23 detected an object in a sensing area 24, the sensing unit 23 sends an actuating signal to the processing unit 22. When the processing unit 22 received the actuating signal, it actuates the driving unit 26 to drive the lid 21 to open to leave the opening 11. At the same time, the processing unit 22 actuates the lighting unit 25 lights at a first lighting mode. When the lid 21 doesn't cover the opening 11, and the sensing unit 23 didn't detect an object in the sensing area 24, the processing unit 22 will actuate the lighting unit 25 lights at a second lighting mode different from the first lighting mode.

When the user wants to drop garbage in a longer period of time, such as cutting something continuously, sorting large amount of garbage, or cutting nails, the lid 21 has to open for a longer period of time, and the user perhaps moves. Because the lighting unit 25 lights at different lighting modes, the user can acknowledge if he leaves the sensing area 24 to prevent the lid 21 from closing. In addition, the sensing area 24 is fan-shaped and has a maximum sensing distance of 40 cm. If it is necessary to make the lid 21 keep opening, the user should keep inside the sensing area 24 as possible.

Preferably, the lighting unit 25 lights continuously at the first lighting mode, and the lighting unit 25 flickers at the second lighting mode. The difference between the two lighting modes is obvious, so the users in any ages can distinguish. Thus, the lighting modes are suitable for the default settings. In other words, the user can acknowledge that he has left the sensing area 24 to result the lid 21 to close the opening 11 when he saw the lighting unit flickering. However, the lighting modes can be changed for different situations.

Preferably, the lighting unit 25 lights in a first color at the first lighting mode, and the lighting unit 25 lights in a second color at the second lighting mode. The second color is different from the first color. Human eyes are sensitive to colors, so the changing of colors can easily make the user notice the difference.

More preferably, the first color and the second color are contrast colors to make the change of colors more obvious in order to call the user's attension.

In the present embodiment, the first color is green, and the second color is red. When the user is inside the sensing area 24 to open the lid 21, the lighting unit 25 lights in green continuously. When the user left the sensing area 24, the lighting unit 25 flickers in red. Specifically, the lighting unit 25 includes a first lighting element 251 and a second lighting element 252. The processing unit 22 actuates the first lighting element 251 to light at the first lighting mode and actuates the second lighting element 252 to light at the second lighting mode. More specifically, each of the first lighting element 251 and the second lighting element 252 is an LED light to have a longer life-time and stronger brightness.

Specifically, the opening system 2 further includes a timer unit 27 which is electrically connected to the processing unit 22. When the opening 11 is not covered by the lid 21, and the sensing unit 23 didn't detect any object in the sensing area 24, the lighting unit 25 will lights at the second lighting mode, and the processing unit 22 actuates the timer unit 27. When the timer unit 27 counts time to a specific time, the timer unit 27 feedbacks a closing signal to the processing unit 22. Thereby, the processing unit 22 actuates the driving unit 26 to drive the lid 21 to close to cover the opening 11.

Preferably, the specific time is smaller than or equal to 10 seconds. Thereby, When the user left the sensing area, the lid 21 can close in a short period of time to prevent flies from entering the receiving space 31 and to prevent pets from touching the garbage in the receiving space 31. In the present embodiment, the specific time is 5 seconds. That is, the lid 21 will close after the lighting unit 25 flickers in red in 5 seconds.

During the timer unit 27 counting time, if the sensing unit 23 detected an object in the sensing area 24, the processing unit 22 stops the timer unit 27 to make it back to the original state. At the same time, the lighting unit 25 is back to the first lighting mode (lighting in green continuously), and the lid 21 is kept opening.

In conclusion, the two lighting modes of the lighting unit of the present invention can make the user easily acknowledge whether he is inside the sensing area or not to prevent the lid from closing when using.

What is claimed is:

1. An inductive garbage bin lid, for being disposed on a barrel, a receiving space being defined between the inductive garbage bin lid and the barrel, the inductive garbage bin lid including:

a main body, formed with an opening for communicating the receiving space;

an opening system, arranged on the main body, including a lid, a processing unit, a lighting unit, and a driving unit, the lid being disposed on the main body to cover the opening at a normal state, the sensing unit and the lighting unit being electrically connected to the processing unit respectively, the driving unit electrically connecting the processing unit and the lid therebetween; when an object is detected by the sensing unit in a sensing area, the sensing unit sending an actuating signal to the processing unit, the processing unit actuating the driving unit to drive the lid to open to leave the opening after received the actuating signal, the processing unit also actuating the lighting unit to light at a first lighting mode; when the opening is not covered by the lid and no object is detected by the sensing unit in the sensing area, the processing unit actuating the lighting unit to light at a second lighting mode different from the first lighting mode.

2. The inductive garbage bin lid of claim 1, wherein the lighting unit includes a first lighting element and a second lighting element, the processing unit actuates the first lighting element to light at the first lighting mode and actuates the second lighting element to light at the second lighting mode.

3. The inductive garbage bin lid of claim 1, wherein the opening system further includes a timer unit, the timer unit is electrically connected to the processing unit; when the opening is not covered by the lid and no object is detected by the sensing unit in the sensing area, the lighting unit lights at the second lighting mode, the processing actuates the timer unit to count time; when the timer unit counted time to a specific time, the timer unit feedbacks a closing signal to the processing unit to make the processing unit to actuate the driving unit to drive the lid to close to cover the opening.

4. The inductive garbage bin lid of claim 3, wherein during the timer unit a counting time, if the sensing unit detected the object in the sensing area, the processing unit stops the timer unit to make the timer unit back to an original state, the lighting unit lights at the first lighting mode, and the lid is kept opened.

5. The inductive garbage bin lid of claim 4, wherein the lighting unit includes a first lighting element and a second lighting element, the processing unit actuates the first lighting element to light at the first lighting mode and actuates the second lighting element to light at the second lighting mode; the lighting unit lights continuously at the first lighting mode; the lighting unit flickers at the second lighting mode; the lighting unit lights in a first color at the first lighting mode, the lighting unit lights in a second color at the second lighting mode, the first color is green, the second color is red; each of the first lighting element and the second lighting element is an LED light; the specific time is 5 seconds;

the sensing area is fan-shaped; the sensing area has a maximum sensing a distance of 40 cm.

6. The inductive garbage bin lid of claim 3, wherein the specific time is smaller than or equal to 10 seconds.

7. The inductive garbage bin lid of claim 1, wherein the lighting unit lights continuously at the first lighting mode.

8. The inductive garbage bin lid of claim 7, wherein the lighting unit flickers at the second lighting mode.

9. The inductive garbage bin lid of claim 1, wherein the lighting unit lights in a first color at the first lighting mode, the lighting unit lights in a second color at the second lighting mode, the first color is different from the second color.

10. The inductive garbage bin lid of claim 9, wherein the first color and the second color are contrast colors.

* * * * *